US012172803B1

(12) United States Patent
Vitello et al.

(10) Patent No.: US 12,172,803 B1
(45) Date of Patent: Dec. 24, 2024

(54) TAMPER EVIDENT INTEGRATED CLOSURE

(71) Applicants: Patrick Vitello, Pompano Beach, FL (US); Panagiotis Peter Vassios, Hypoluxo, FL (US)

(72) Inventors: Patrick Vitello, Pompano Beach, FL (US); Panagiotis Peter Vassios, Hypoluxo, FL (US)

( * ) Notice: Subject to any disclaimer, the term of this patent is extended or adjusted under 35 U.S.C. 154(b) by 0 days.

(21) Appl. No.: 17/959,955

(22) Filed: Oct. 4, 2022

Related U.S. Application Data

(60) Provisional application No. 63/339,925, filed on May 9, 2022, provisional application No. 63/252,016, filed on Oct. 4, 2021.

(51) Int. Cl.
*B65D 41/46* (2006.01)
*B65D 47/12* (2006.01)
*B65D 47/18* (2006.01)

(52) U.S. Cl.
CPC ..... *B65D 41/46* (2013.01); *B65D 47/125* (2013.01); *B65D 47/18* (2013.01); *B65D 2401/15* (2020.05)

(58) Field of Classification Search
CPC .... B65D 1/0238; B65D 1/023; B65D 1/0223; B65D 41/46; B65D 41/3409; B65D 41/3428; B65D 47/125; B65D 47/12; B65D 47/06
USPC .... 215/252, 253, 250, 224, 44, 43; 220/266, 220/265
See application file for complete search history.

(56) References Cited

U.S. PATENT DOCUMENTS

| | | | |
|---|---|---|---|
| 722,943 | A | 3/1903 | Chappell |
| 732,662 | A | 6/1903 | Smith |
| 1,678,991 | A | 7/1928 | Marschalek |
| 1,970,631 | A | 8/1934 | Sherman |
| 2,186,888 | A | 1/1940 | Tullar et al. |
| 2,277,936 | A | 3/1942 | Rosenblatt |
| 2,459,304 | A | 1/1949 | Blank |
| 2,477,598 | A | 8/1949 | Hain |

(Continued)

FOREIGN PATENT DOCUMENTS

| | | |
|---|---|---|
| DE | 202008018507 | 2/2015 |
| EP | 0148116 | 7/1985 |

(Continued)

OTHER PUBLICATIONS

Arai Tsugio, Pilfering Proof Cap, Jan. 9, 1996.

*Primary Examiner* — Robert J Hicks
(74) *Attorney, Agent, or Firm* — Malloy & Malloy, P.L.; Jennie S. Malloy

(57) ABSTRACT

A closure for a medical solution containing bottle, including a cap having a shroud disposed in closing relation to the neck and access opening of the bottle. The cap is removably connected to the bottle and may include a shrouded tamper evident indicator member connected to an interior surface of the shroud, at least initially inwardly of an open end of thereof in a non-visually observable location. Upon removal of the cap from the bottle and replacement thereof, the indicator member will be disposed exteriorly of the shroud in a visually observable location on the bottle. The closure may also include a spout integrated into the cap in a fixed, removable connection therewith, such that the spout is movable with the cap into closing relation of cap to the bottle neck and access opening.

24 Claims, 8 Drawing Sheets

(56) References Cited

U.S. PATENT DOCUMENTS 2,734,665 A 2/1956 Flamm
2,739,590 A 3/1956 Yochem
2,811,283 A 10/1957 Bowen
2,823,674 A 2/1958 Yochem
2,834,346 A 5/1958 Adams
2,875,761 A 3/1959 Helmer et al.
2,888,015 A 5/1959 Hunt
2,952,255 A 9/1960 Hein, Jr.
3,122,280 A 2/1964 Goda
3,180,532 A 4/1965 Michel
3,245,567 A 4/1966 Knight
3,323,798 A 6/1967 Miller
3,364,890 A 1/1968 Andersen
3,368,673 A 2/1968 Johnson
3,489,268 A 1/1970 Meierhoefer
3,568,673 A 3/1971 Cowley
3,574,306 A 4/1971 Alden
3,598,120 A 8/1971 Mass
3,610,241 A 10/1971 LeMarie
3,674,181 A 7/1972 Marks et al.
3,700,215 A 10/1972 Hardman et al.
3,706,307 A 12/1972 Hasson
3,712,749 A 1/1973 Roberts
3,726,445 A 4/1973 Ostrowsky et al.
3,747,751 A 7/1973 Miller et al.
3,850,329 A 11/1974 Robinson
3,872,867 A 3/1975 Killinger
3,904,033 A 9/1975 Haerr
3,905,375 A 9/1975 Toyama
3,937,211 A 2/1976 Merten
3,987,930 A 10/1976 Fuson
4,005,739 A 2/1977 Winchell
4,043,334 A 8/1977 Brown et al.
4,046,145 A 9/1977 Choksi et al.
4,068,696 A 1/1978 Winchell
4,085,845 A 4/1978 Perfect
4,106,621 A 8/1978 Sorenson
4,216,585 A 8/1980 Hatter
4,216,872 A 8/1980 Bean
4,244,366 A 1/1981 Raines
4,252,122 A 2/1981 Halvorsen
4,271,972 A 6/1981 Thor
4,286,591 A 9/1981 Raines
4,286,640 A 9/1981 Knox et al.
4,313,539 A 2/1982 Raines
4,369,781 A 1/1983 Gilson et al.
4,420,085 A 12/1983 Wilson et al.
4,430,077 A 2/1984 Mittleman et al.
4,433,790 A 2/1984 Gibson
4,457,445 A 7/1984 Hanks et al.
4,482,071 A 11/1984 Ishiwatari
D277,783 S 2/1985 Beck
4,520,942 A 6/1985 Dwinell
4,521,237 A 6/1985 Logothetis
4,530,697 A 7/1985 Kuhlemann et al.
4,571,242 A 2/1986 Klien et al.
4,589,171 A 5/1986 McGill
4,664,259 A 5/1987 Landis
4,667,837 A 5/1987 Vitello et al.
4,676,530 A 6/1987 Nordgren et al.
4,693,707 A 9/1987 Dye
4,726,483 A 2/1988 Drozd
4,735,617 A 4/1988 Nelson et al.
4,742,910 A 5/1988 Staebler
4,743,229 A 5/1988 Chu
4,743,231 A 5/1988 Kay et al.
4,753,345 A 6/1988 Goodsir et al.
4,760,847 A 8/1988 Vaillancourt
4,813,564 A 3/1989 Cooper et al.
4,832,695 A 5/1989 Rosenberg et al.
4,834,706 A 5/1989 Beck et al.
4,842,592 A 6/1989 Caggiani et al.
4,844,906 A 7/1989 Hermelin et al.
4,863,451 A 9/1989 Marder
4,906,231 A 3/1990 Young
4,919,285 A 4/1990 Roof et al.
4,936,445 A 6/1990 Grabenkort
5,007,535 A 4/1991 Meseke et al.
5,009,323 A 4/1991 Montgomery et al.
5,024,323 A 6/1991 Bolton
5,049,129 A 9/1991 Zdeb et al.
5,057,093 A 10/1991 Clegg et al.
D323,392 S 1/1992 Bryne
5,078,696 A 1/1992 Nedbaluk
5,085,332 A 2/1992 Gettig et al.
5,090,564 A 2/1992 Chimienti
5,133,454 A 7/1992 Hammer
5,135,496 A 8/1992 Vetter et al.
5,163,922 A 11/1992 McElveen, Jr. et al.
5,165,560 A 11/1992 Ennis, III et al.
5,230,429 A 7/1993 Etheredge, III
5,267,983 A 12/1993 Oilschlager et al.
5,292,308 A 3/1994 Ryan
5,293,993 A 3/1994 Yates, Jr. et al.
5,295,599 A 3/1994 Smith
5,312,367 A 5/1994 Nathan
5,312,368 A 5/1994 Haynes
5,316,163 A 5/1994 von Schuckmann
5,328,466 A 7/1994 Denmark
5,328,474 A 7/1994 Raines
5,332,113 A 7/1994 Kusler, III et al.
5,356,380 A 10/1994 Hoekwater et al.
5,370,226 A 12/1994 Gollobin et al.
5,380,295 A 1/1995 Vacca
5,402,887 A 4/1995 Shillington
5,405,339 A 4/1995 Kohnen et al.
5,456,668 A 10/1995 Ogle, II
5,458,580 A 10/1995 Hajishoreh
5,468,224 A 11/1995 Souryal
5,474,178 A 12/1995 DiViesti et al.
5,505,705 A 4/1996 Galpin et al.
5,531,695 A 7/1996 Swisher
5,540,324 A 7/1996 Knapp
5,540,666 A 7/1996 Barta et al.
5,549,571 A 8/1996 Sak
5,558,648 A 9/1996 Shields
5,584,817 A 12/1996 van den Haak
5,588,239 A 12/1996 Anderson
5,611,445 A 3/1997 Kano et al.
5,617,954 A 4/1997 Kato et al.
5,624,402 A 4/1997 Imbert
5,662,233 A 9/1997 Reid
5,674,209 A 10/1997 Yarger
5,695,470 A 12/1997 Roussigne et al.
5,699,913 A 12/1997 Richardson
5,700,247 A 12/1997 Grimard et al.
5,702,374 A 12/1997 Johnson
5,713,485 A 2/1998 Liff et al.
5,776,124 A 7/1998 Wald
5,785,691 A 7/1998 Vetter et al.
5,797,885 A 8/1998 Rubin
5,807,343 A 9/1998 Tucker et al.
5,829,589 A 11/1998 Nguyen et al.
D402,766 S 12/1998 Smith et al.
5,842,567 A 12/1998 Rowe et al.
5,876,381 A 3/1999 Pond et al.
5,883,806 A 3/1999 Meador et al.
5,884,457 A 3/1999 Ortiz et al.
5,901,866 A 5/1999 Storar
5,902,269 A 5/1999 Jentzen
5,926,922 A 7/1999 Stottle
5,951,522 A 9/1999 Rosato et al.
5,951,525 A 9/1999 Thorne et al.
5,954,203 A 9/1999 Marconi
5,954,657 A 9/1999 Rados
5,957,166 A 9/1999 Safabash
5,957,314 A 9/1999 Nishida et al.
5,963,136 A 10/1999 O'Brien
5,989,227 A 11/1999 Vetter et al.
5,993,437 A 11/1999 Raoz
6,000,548 A 12/1999 Tsals
D419,671 S 1/2000 Jansen
6,021,824 A 2/2000 Larsen et al.
6,027,482 A 2/2000 Imbert

(56) References Cited

U.S. PATENT DOCUMENTS 6,068,614 A 5/2000 Kimber et al.
D430,293 S 8/2000 Jansen
6,112,951 A 9/2000 Mueller
D431,864 S 10/2000 Jansen
6,126,640 A 10/2000 Tucker et al.
6,190,364 B1 2/2001 Imbert
6,193,688 B1 2/2001 Balestracci et al.
6,196,593 B1 3/2001 Petrick et al.
6,196,998 B1 3/2001 Jansen et al.
6,216,885 B1 4/2001 Guillaume
6,279,746 B1 4/2001 Hussaini et al.
6,235,376 B1 5/2001 Miyazaki et al.
6,280,418 B1 8/2001 Reinhard et al.
6,287,671 B1 9/2001 Bright et al.
6,322,543 B1 11/2001 Singh et al.
6,338,200 B1 1/2002 Baxa et al.
6,358,241 B1 3/2002 Shapeton et al.
6,375,640 B1 4/2002 Teraoka
6,394,983 B1 5/2002 Mayoral et al.
6,439,276 B1 8/2002 Wood et al.
6,485,460 B2 11/2002 Eakins et al.
6,488,666 B1 12/2002 Geist
6,491,665 B1 12/2002 Vetter et al.
6,500,155 B2 12/2002 Sasso
6,520,935 B1 2/2003 Jansen et al.
6,540,697 B2 4/2003 Chen
6,565,529 B1 5/2003 Kimber et al.
6,581,792 B1 6/2003 Limanjaya
6,585,691 B1 7/2003 Vitello
6,592,251 B2 7/2003 Edwards et al.
6,666,852 B2 12/2003 Niedospial, Jr.
6,682,798 B1 1/2004 Kiraly
6,726,652 B2 4/2004 Eakins et al.
6,726,672 B1 4/2004 Hanly et al.
6,764,469 B2 7/2004 Broselow
6,796,586 B2 9/2004 Werth
6,821,268 B2 11/2004 Balestracci
D501,549 S 2/2005 McAllister et al.
6,921,383 B2 7/2005 Vitello
6,935,560 B2 8/2005 Andreasson et al.
6,942,643 B2 9/2005 Eakins et al.
6,991,126 B2 1/2006 Jackel
7,036,661 B2 5/2006 Anthony et al.
7,055,273 B2 6/2006 Roshkoff
7,100,771 B2 9/2006 Massengale et al.
7,125,397 B2 10/2006 Woehr et al.
7,141,286 B1 11/2006 Kessler et al.
7,175,081 B2 2/2007 Andreasson et al.
7,182,256 B2 2/2007 Andreasson et al.
7,232,066 B2 6/2007 Anderasson et al.
7,240,926 B2 7/2007 Dalle et al.
7,299,981 B2 11/2007 Hickle et al.
7,374,555 B2 5/2008 Heinz et al.
7,404,500 B2 7/2008 Marteau et al.
7,410,803 B2 8/2008 Nollert et al.
7,425,208 B1 9/2008 Vitello
7,437,972 B2 10/2008 Yeager
D581,046 S 11/2008 Sudo
D581,047 S 11/2008 Koshidaka
D581,049 S 11/2008 Sudo
7,482,166 B2 1/2009 Nollert et al.
D589,612 S 3/2009 Sudo
7,497,330 B2 3/2009 Anthony et al.
7,503,453 B2 3/2009 Cronin et al.
7,588,563 B2 9/2009 Guala
7,594,681 B2 9/2009 DeCarlo
7,608,057 B2 10/2009 Woehr et al.
7,611,487 B2 11/2009 Woehr et al.
7,632,244 B2 12/2009 Buehler et al.
D608,900 S 1/2010 Giraud et al.
7,641,636 B2 1/2010 Moesli et al.
D612,939 S 3/2010 Boone, III et al.
7,681,606 B2 3/2010 Khan et al.
7,698,180 B2 4/2010 Fago et al.
7,735,664 B1 6/2010 Peters et al.
7,748,892 B2 7/2010 McCoy
7,762,988 B1 7/2010 Vitello
7,766,919 B2 8/2010 Delmotte
7,802,313 B2 9/2010 Czajka
7,886,908 B2 2/2011 Farrar et al.
7,918,830 B2 4/2011 Langan et al.
7,922,213 B2 4/2011 Werth
7,988,004 B1 * 8/2011 Marret ..... B65D 51/18 220/254.8
8,034,041 B2 10/2011 Domkowski et al.
8,079,518 B2 12/2011 Turner et al.
8,091,727 B2 1/2012 Domkowwski
8,118,788 B2 2/2012 Frezza
8,120,484 B2 2/2012 Chisholm
8,137,324 B2 3/2012 Bobst
8,140,349 B2 3/2012 Hanson et al.
8,252,247 B2 8/2012 Ferlic
8,257,286 B2 9/2012 Meyer et al.
8,328,082 B1 12/2012 Bochenko et al.
8,348,895 B1 1/2013 Vitello
8,353,869 B2 1/2013 Ranalletta et al.
8,413,811 B1 4/2013 Arendt
8,443,999 B1 5/2013 Reinders
D684,057 S 6/2013 Kwon
8,512,277 B2 8/2013 Del Vecchio
8,528,757 B2 9/2013 Bisio
8,556,074 B2 10/2013 Turner et al.
8,579,116 B2 11/2013 Pether et al.
8,591,462 B1 11/2013 Vitello
8,597,255 B2 12/2013 Emmott et al.
8,597,271 B2 12/2013 Langan et al.
8,616,413 B2 12/2013 Koyama
D701,304 S 3/2014 Lair et al.
8,672,902 B2 3/2014 Ruan et al.
8,702,674 B2 4/2014 Bochenko
8,777,910 B2 7/2014 Bauss et al.
8,777,930 B2 7/2014 Swisher et al.
8,852,561 B2 10/2014 Wagner et al.
8,864,021 B1 10/2014 Vitello
8,864,707 B1 10/2014 Vitello
8,864,708 B1 10/2014 Vitello
8,911,424 B2 12/2014 Weadock et al.
8,945,082 B2 2/2015 Geiger et al.
8,978,909 B2 3/2015 Kakutani et al.
9,016,473 B2 4/2015 Tamarindo
9,027,769 B2 5/2015 Willows et al.
9,082,157 B2 7/2015 Gibson
9,101,534 B2 8/2015 Bochenko
D738,495 S 9/2015 Strong et al.
9,125,976 B2 9/2015 Uber, III et al.
D743,019 S 11/2015 Schultz
9,192,443 B2 11/2015 Tennican
9,199,042 B2 12/2015 Farrar et al.
9,199,749 B1 12/2015 Vitello et al.
9,220,486 B2 12/2015 Schweiss et al.
9,220,577 B2 12/2015 Jessop et al.
9,227,019 B2 1/2016 Swift et al.
D750,228 S 2/2016 Strong et al.
9,272,099 B2 3/2016 Limaye et al.
9,311,592 B1 4/2016 Vitello et al.
D756,777 S 5/2016 Berge et al.
9,336,669 B2 5/2016 Bowden et al.
D759,486 S 6/2016 Ingram et al.
D760,384 S 6/2016 Niunoya et al.
D760,902 S 7/2016 Persson
9,402,967 B1 8/2016 Vitello
9,427,715 B2 8/2016 Palazzolo et al.
9,433,768 B2 9/2016 Tekeste et al.
9,463,310 B1 10/2016 Vitello
D773,043 S 11/2016 Ingram et al.
D777,903 S 1/2017 Schultz
9,662,456 B2 5/2017 Woehr
D789,529 S 6/2017 Davis et al.
9,687,249 B2 6/2017 Hanlon et al.
9,694,948 B1 * 7/2017 Pakhomov ..... B65D 41/3409
9,744,304 B2 8/2017 Swift et al.
D797,928 S 9/2017 Davis et al.
D797,929 S 9/2017 Davis et al.
9,764,098 B2 9/2017 Hund et al.

(56) References Cited

U.S. PATENT DOCUMENTS 9,821,152 B1 11/2017 Vitello et al.
D806,241 S 12/2017 Swinney et al.
D807,503 S 1/2018 Davis et al.
9,855,191 B1 1/2018 Vitello et al.
D815,945 S 4/2018 Fischer
9,987,438 B2 6/2018 Stillson
D825,746 S 8/2018 Davis et al.
10,039,913 B2 8/2018 Yeh et al.
D831,201 S 10/2018 Holtz et al.
D834,187 S 11/2018 Ryan
10,124,122 B2 11/2018 Zenker
10,166,343 B1 1/2019 Hunt et al.
10,166,347 B1 1/2019 Vitello
10,183,129 B1 1/2019 Vitello
10,207,099 B1 2/2019 Vitello
D842,464 S 3/2019 Davis et al.
D847,373 S 4/2019 Hurwit et al.
10,293,987 B2 5/2019 Sattig et al.
10,300,263 B1 5/2019 Hunt
10,307,548 B1 6/2019 Hunt et al.
10,315,024 B1 6/2019 Vitello et al.
10,315,808 B2 6/2019 Taylor et al.
10,376,655 B2 8/2019 Pupke et al.
D859,125 S 9/2019 Weagle et al.
10,478,262 B2 11/2019 Niese et al.
10,555,872 B1 2/2020 Thorne
10,758,684 B1 9/2020 Vitello et al.
10,773,067 B2 9/2020 Davis et al.
10,800,556 B2 10/2020 Thorne et al.
D903,865 S 12/2020 Banik et al.
10,888,672 B1 1/2021 Vitello
10,898,659 B1 1/2021 Vitello et al.
10,912,898 B1 2/2021 Vitello et al.
10,933,202 B1 3/2021 Banik
10,940,087 B2 3/2021 Thorne et al.
10,953,162 B1 3/2021 Hunt et al.
11,040,149 B1 6/2021 Banik
11,040,154 B1 6/2021 Vitello et al.
11,097,071 B1 8/2021 Hunt et al.
11,278,681 B1 3/2022 Banik et al.
D948,713 S 4/2022 Banik
11,357,588 B1 6/2022 Vitello et al.
11,413,406 B1 8/2022 Vitello et al.
11,426,328 B1 8/2022 Ollmann et al.
11,471,610 B1 10/2022 Banik et al.
11,523,970 B1 12/2022 Vitello et al.
11,541,180 B1 1/2023 Vitello et al.
11,690,994 B1 7/2023 Banik et al.
11,697,527 B1 7/2023 Hendren et al.
11,779,520 B1 10/2023 Vitello
11,793,987 B1 10/2023 Vitello et al.
11,857,751 B1 1/2024 Vitello
11,872,187 B1 1/2024 Vitello et al.
11,904,149 B1 2/2024 Vitello et al.
11,911,339 B1 2/2024 Lehel et al.
12,070,591 B1 8/2024 Vitello
2001/0003150 A1 6/2001 Imbert
2001/0034506 A1 10/2001 Hirschman et al.
2001/0056258 A1 12/2001 Evans
2002/0007147 A1 1/2002 Capes et al.
2002/0023409 A1 2/2002 Py
2002/0046962 A1 4/2002 Vallans et al.
2002/0079281 A1 6/2002 Hierzer et al.
2002/0097396 A1 7/2002 Schafer
2002/0099334 A1 7/2002 Hanson et al.
2002/0101656 A1 8/2002 Blumenthal et al.
2002/0104770 A1 8/2002 Shapeton et al.
2002/0133119 A1 9/2002 Eakins et al.
2003/0055685 A1 3/2003 Cobb et al.
2003/0146617 A1 8/2003 Franko, Sr.
2003/0183547 A1 10/2003 Heyman
2003/0187403 A1 10/2003 Balestracci
2004/0008123 A1 1/2004 Carrender et al.
2004/0064095 A1 4/2004 Vitello
2004/0116858 A1 6/2004 Heinz et al.
2004/0173563 A1 9/2004 Kim et al.
2004/0186437 A1 9/2004 Frenette et al.
2004/0225258 A1 11/2004 Balestracci
2005/0146081 A1 7/2005 MacLean et al.
2005/0148941 A1 7/2005 Farrar et al.
2005/0209555 A1 9/2005 Middleton et al.
2006/0049948 A1 3/2006 Chen et al.
2006/0084925 A1 4/2006 Ramsahoye
2006/0089601 A1 4/2006 Dionigi
2006/0169611 A1 8/2006 Prindle
2006/0173415 A1 8/2006 Cummins
2006/0189933 A1 8/2006 Alheidt et al.
2007/0060898 A1 3/2007 Shaughnessy et al.
2007/0106234 A1 5/2007 Klein
2007/0142786 A1 6/2007 Lampropoulos et al.
2007/0191690 A1 8/2007 Hasse et al.
2007/0219503 A1 9/2007 Loop et al.
2007/0257111 A1 11/2007 Ortenzi
2008/0068178 A1 3/2008 Meyer
2008/0097310 A1 4/2008 Buehler et al.
2008/0106388 A1 5/2008 Knight
2008/0140020 A1 6/2008 Shirley
2008/0243088 A1 10/2008 Evans
2008/0303267 A1 12/2008 Schnell et al.
2008/0306443 A1 12/2008 Neer
2009/0084804 A1 4/2009 Caspary et al.
2009/0099552 A1 4/2009 Levy et al.
2009/0149815 A1 6/2009 Kiel et al.
2009/0166311 A1 7/2009 Claessens
2009/0212954 A1 8/2009 Adstedt et al.
2009/0326481 A1 12/2009 Swisher et al.
2010/0050351 A1 3/2010 Colantonio et al.
2010/0051491 A1 3/2010 Lampropoulos et al.
2010/0084403 A1 4/2010 Popish et al.
2010/0089862 A1 4/2010 Schmitt
2010/0126894 A1 5/2010 Koukol et al.
2010/0179822 A1 7/2010 Reppas
2010/0211016 A1 8/2010 Palmer-Felgate
2010/0228226 A1 9/2010 Nielsen
2010/0252564 A1 10/2010 Martinez et al.
2010/0283238 A1 11/2010 Deighan et al.
2011/0044850 A1 2/2011 Solomon et al.
2011/0046550 A1 2/2011 Schiller et al.
2011/0046603 A1 2/2011 Felsovalyi et al.
2012/0064515 A2 3/2012 Knapp et al.
2012/0096957 A1 4/2012 Ochman
2012/0110950 A1 5/2012 Schraudolph
2013/0018356 A1 1/2013 Prince et al.
2013/0018536 A1 1/2013 Prince et al.
2013/0056130 A1 3/2013 Alpert et al.
2013/0088354 A1 4/2013 Thomas
2013/0237949 A1 9/2013 Miller
2013/0269592 A1 10/2013 Heacock et al.
2014/0000781 A1 1/2014 Franko, Jr.
2014/0034536 A1 2/2014 Reinhardt et al.
2014/0069202 A1 3/2014 Fisk
2014/0069829 A1 3/2014 Evans
2014/0076840 A1 3/2014 Graux et al.
2014/0135738 A1 5/2014 Panian
2014/0155868 A1 6/2014 Nelson et al.
2014/0163465 A1 6/2014 Bartlett, II et al.
2014/0257843 A1 9/2014 Adler et al.
2014/0326727 A1 11/2014 Jouin et al.
2014/0353196 A1 12/2014 Key
2015/0013811 A1 1/2015 Carrel et al.
2015/0048045 A1 2/2015 Miceli et al.
2015/0112296 A1 4/2015 Ishiwata et al.
2015/0136632 A1 5/2015 Moir et al.
2015/0182686 A1 7/2015 Okihara
2015/0191633 A1 7/2015 De Boer et al.
2015/0246185 A1 9/2015 Heinz
2015/0251820 A1* 9/2015 Glaser ..... B65D 41/3447 220/288
2015/0302232 A1 10/2015 Strassburger et al.
2015/0305982 A1 10/2015 Bochenko
2015/0310771 A1 10/2015 Atkinson et al.
2016/0067144 A1 3/2016 Chang
2016/0067422 A1 3/2016 Davis et al.
2016/0090456 A1 3/2016 Ishimaru et al.

(56) References Cited

U.S. PATENT DOCUMENTS

| | | | |
|---|---|---|---|
| 2016/0136352 | A1 | 5/2016 | Smith et al. |
| 2016/0144119 | A1 | 5/2016 | Limaye et al. |
| 2016/0158110 | A1 | 6/2016 | Swisher et al. |
| 2016/0158449 | A1 | 6/2016 | Limaye et al. |
| 2016/0176550 | A1 | 6/2016 | Viitello et al. |
| 2016/0194121 | A1 | 7/2016 | Ogawa et al. |
| 2016/0250420 | A1 | 9/2016 | Maritan et al. |
| 2016/0279032 | A1 | 9/2016 | Davis |
| 2016/0328586 | A1 | 11/2016 | Bowden et al. |
| 2016/0361235 | A1 | 12/2016 | Swisher |
| 2016/0367439 | A1 | 12/2016 | Davis et al. |
| 2017/0007771 | A1 | 1/2017 | Duinat et al. |
| 2017/0014310 | A1 | 1/2017 | Hyun et al. |
| 2017/0124289 | A1 | 5/2017 | Hasan et al. |
| 2017/0173321 | A1 | 6/2017 | Davis et al. |
| 2017/0203086 | A1 | 7/2017 | Davis |
| 2017/0225843 | A1 | 8/2017 | Glaser et al. |
| 2017/0239141 | A1 | 8/2017 | Davis et al. |
| 2017/0297781 | A1 | 10/2017 | Kawamura |
| 2017/0319438 | A1 | 11/2017 | Davis et al. |
| 2017/0349335 | A1 | 12/2017 | Sattig et al. |
| 2017/0354792 | A1 | 12/2017 | Ward |
| 2018/0001540 | A1 | 1/2018 | Byun |
| 2018/0014998 | A1 | 1/2018 | Yuki et al. |
| 2018/0064604 | A1 | 3/2018 | Drmanovic |
| 2018/0078684 | A1 | 3/2018 | Peng et al. |
| 2018/0089593 | A1 | 3/2018 | Patel et al. |
| 2018/0098915 | A1 | 4/2018 | Rajagopal et al. |
| 2018/0147115 | A1 | 5/2018 | Nishioka et al. |
| 2018/0312305 | A1 | 11/2018 | Rognard |
| 2019/0308006 | A1 | 10/2019 | Erekovcanski et al. |
| 2019/0388626 | A1 | 12/2019 | Okihara |
| 2022/0008645 | A1 | 1/2022 | Ukai et al. |
| 2022/0339067 | A1 | 10/2022 | Christine et al. |

FOREIGN PATENT DOCUMENTS

| | | |
|---|---|---|
| EP | 269920 | 6/1988 |
| GB | 486367 | 6/1938 |
| JP | 08002544 | 1/1996 |
| KR | 101159987 | 6/2012 |
| WO | WO2008000279 | 1/2008 |
| WO | WO2017086607 | 5/2015 |

* cited by examiner

TAMPER EVIDENT INTEGRATED CLOSURE

CLAIM OF PRIORITY

The present application is based on, and a claim of priority is made under 35 U.S.C. Section 119 (e) to a provisional patent application that is in the U.S. Patent and Trademark Office, namely, that having Ser. No. 63/252,016, and a filing date of Oct. 4, 2021, as well as to another provisional patent application in the U.S. Patent and Trademark Office, namely, that having Ser. No. 63/339,925, and a filing date of May 9, 2022, with the contents of both being incorporated herein by reference, in their entireties.

BACKGROUND OF THE INVENTION

Field of the Invention

The present invention is directed to a closure, which may include tamper evident capabilities as well as an integrated spout and cap, which may be removably attached in a closing relation to a neck portion and/or access opening of a bottle intended for the containment of a medical solution. One or more embodiments of the closure may also facilitate dispensing of the contained medical solution, or other contained solution.

Description of the Related Art

Ophthalmic preparations and solutions are commonly used to treat a wide variety of conditions, including, without limitation, allergies, bacterial and viral infections, and other eye conditions, such as glaucoma. Indeed, sterile ophthalmic compounds are currently widely used in 503A, 503B, eye institutes, and general hospital pharmacy facilities around the world. Likewise, ophthalmic preparations are widely used in veterinary compounding.

Generally speaking, a typical ophthalmic drug, when compounded, includes several components including, without limitation: an ophthalmic container assembly comprising a bottle, a cap, and a nozzle, which must be assembled and filled while maintaining an aseptic technique for the disposition of a liquid, such as a drug, therein. As may be understood, such aseptic techniques require strict procedures for preparing the drug, such procedures including the preparation thereof within a sterile, Class 5 clean room environment, the preparation therein under a laminal flow hood, and the avoidance of touching component surfaces which may contact the given drug. Because the bottle, cap, and nozzle of the ophthalmic container assembly are, at least initially, separate components, it may be understood the aseptic preparation of an ophthalmic drug can be difficult, time-consuming and labor-intensive. Indeed, one critical step in such a preparation is the assembly of the nozzle on the bottle in a dispensing orientation. As such, the nozzle will typically be in direct contact with the corresponding drug to be dispensed. As a result, the nozzle must be assembled into the ophthalmic container or bottle without personnel or exterior objects touching the nozzle. Such careful assembly must be practiced at least until such ophthalmic container has been filled with the intended solution.

Given these difficulties, there exists a need in the art for a solution to these problems pertaining to the preparation and/or compounding of ophthalmic drugs. If it were possible, one solution might be to develop an improved assembly having a cover structure to facilitate dispensing in the intended manner and a container, preferably in the form of a bottle, for the containment of the intended of ophthalmic or other medical and/or non-medical solution. If any such improved assembly were developed it would preferably also be structurally operative to facilitate maintenance of required sterile conditions by avoiding contact with a nozzle portion of the closure while being secured in fluid communicating relation to the interior of the ophthalmic container or bottle. Moreover, if any such improved assembly were developed it could prove helpful to include cooperative structuring of the closure structure to include a cap which may be secured to the ophthalmic container or bottle in a manner which eliminates or significantly restricts the possibility of contact with the nozzle, while concurrently enabling accurate, reliable and consistent placement of the nozzle in the intended dispensing orientation relative to the ophthalmic container or bottle, such as in an access opening thereof. Moreover, if any such assembly were developed it would preferably also be versatile with an ability to dispense the intended or prescribed solutions, compounds, etc. other than an ophthalmic solution.

SUMMARY OF THE INVENTION

The present invention is directed to an assembly for containment and dispensing of a solution specifically including, but not limited to, the containment and dispensing of an ophthalmic or other medical solution, preparation, compound, etc. Moreover, structural and operative features of the various components of the inventive assembly enable the intended attachment or connection to one another in a manner which maintains required or desired aseptic conditions or techniques. Such aseptic conditions or techniques include, but are not limited to the avoidance of contact with portions of the assembly which come into direct engagement with the solution, compound, etc. being dispensed. As is apparent from the detailed description of various embodiments of the present invention provided herein, the subject assembly may be specifically used for the droplet or "drop-by-drop" dispensing of an ophthalmic solution and as such, may be in the form of an eyedropper assembly. However, the versatility of the present invention enables the containment and dispensing of solutions other than ophthalmic or medical solutions.

Therefore, at least one embodiment of the present invention includes a closure for a container intended for retaining a medical or other solution, wherein the container may be in the form of a bottle. As explained in greater detail hereinafter, one or more embodiments of the present invention may utilize a somewhat conventionally structured bottle. In the alternative, a bottle having at least some customized structural and operative features may be utilized.

Further, in at least one embodiment of the invention, the closure includes a cap having a shroud with an open end through which a neck portion of the bottle passes to accomplish a connected, closing relation of the cap with the bottle's neck or neck portion. In cooperation therewith, a spout or nozzle is disposed in closing relation or engagement with an access opening of the bottle. The shroud of the cap is disposed, dimensioned and structured to surround and substantially enclose an at least partially hollow interior of the cap. Also, the closure may include an indicator member structured to provide evidence of tampering, such as by providing a clear visual indication of an initial removal of the cap from the aforementioned closing relation to the neck and/or access opening of the bottle.

In at least one embodiment, the indicator member includes a base and an indicator segment, wherein the indicator segment is removably and/or detachably connected to the base. As initially produced, the indicator member may be formed by injection molding and assembled by fixedly disposing, connecting or attaching the indicator member to an interior of the cap, and in such a secured position, the indicator member will preferably be disposed inwardly of the open end of the shroud. Also, in such a secured interior position, the indicator member will preferably not be visually observable from an exterior of the cap, when the cap is disposed in the aforementioned closed relation to the neck of the bottle and access opening. For purposes of clarity, it is emphasized that the preferably non-visually observable position of the indicator member while connected on the interior of the cap, and concurrent to the cap being secured or disposed in closing relation to the bottle is meant to describe that there is significant difficulty in an ability to view the indicator member. This is due at least in part to the cooperative structuring of the closure, including the cap and the dimension and configuration of the bottle, which would render viewing of the indicator member, while intact within the interior of the cap difficult, but not necessarily impossible.

As noted above, additional structural and operative features of the indicator member include a base and an indicator segment. The indicator segment is removably attached to the base of the indicator member preferably by a frangible, breakable connection. The structural features of such a frangible connection are such as to cause the breakage thereof and the detachment of the indicator segment from the base upon a removal of the cap from its connected, closed relation to the neck and access opening of the bottle. As described in greater detail hereinafter, the cooperative structuring of the cap and the exterior portion of the bottle neck may be such as to at least partially define a removable, threaded attachment of the cap to the neck of the bottle. Accordingly, an unscrewing or unthreading of the cap relative to the bottle neck will result in both rotational forces (torque) and axial load or force being exerted on the indicator member. In that the base is secured to the interior surface of the cap and/or shroud, it is movable therewith upon removal of the cap from the bottle.

Such removal force will be sufficient to break the frangible connection causing a detachment of the indicator segment from the base. Once so detached, the indicator segment will fall, pass or drop through the open end of the shroud onto a lower portion of the neck. The dimension and configuration of the shroud are such as to leave an uncovered space or opening on the neck below the open end of the shroud. Therefore, upon disconnection of the indicator segment from the base and the passage of the detached indicator segment through the open end of the shroud, it will be disposed within the opening or space on the bottle neck in a position which is clearly, visually observable. Therefore, the indicator segment will normally be disposed exteriorly of the shroud, even when the cap is reconnected in the closing relation to the bottle neck and access opening of the bottle.

Further, the visually observable location of the indicator segment, once detached from the base, will be sufficiently removed or spaced from the open end of the shroud to facilitate its visual observation. Accordingly, the tamper evident capabilities of the indicator member will include the clear visual observation of the indicator segment, once detached from the base of the indicator member, as the cap is removed or unscrewed from the neck of the bottle. Moreover, if and when the cap is replaced in closing relation to the neck and access opening of the bottle, the detached indicator segment will still remain exteriorly of the shroud and thereby, be clearly observable. Such observance will provide a clear indication that the cap had been previously and/or originally removed, rendering the contents of the bottle accessible and no longer sterile. In order to further emphasize the location of the detached indicator segment when disposed exteriorly of the shroud, it may include a bright or easily noticeable color, preferably distinguishable from the color of the cap or bottle.

Yet additional structural features of at least one embodiment of the present invention includes the indicator member, including both the base and the indicator segment, having a substantially annular or ring-like configuration. As such, the indicator member, when intact and fixedly connected to the interior surface of the cap, will be disposed inwardly from the open end of the shroud. When the cap is connected in the closing relation to the neck and opening of the bottle, the indicator member, including the base and the indicator segment, will be disposed in surrounding relation to the neck of the bottle.

In order to facilitate the aforementioned detachment of the indicator segment from the base, the indicator member is cooperatively structured with a portion of the neck of the bottle, such as with an exterior protrusion formed thereon, to enable a snap-fit connection therebetween. Such a snap fit connection is facilitated by a portion of the indicator member such as, but not limited to, the frangible structure or connection being at least minimally flexible. In cooperation therewith, the indicator segment or other appropriate portion of the indicator member will be cooperatively disposed and structured with the aforementioned exterior protrusion on the neck of the bottle. Therefore, when the cap is screwed onto or otherwise secured in closing relation to the neck and the access opening of the bottle, the indicator segment will movably engage and slide over an appropriately and cooperatively configured part of the aforementioned exterior protrusion extending outwardly from the outer surface of the bottle neck.

Therefore, such a snap-fit connection will further facilitate an initially secure engagement of the indicator segment with the neck of the bottle, when it is still attached to the base and while the base of the indicator member is fixedly secured to the interior surface of the shroud. However, upon detachment of the indicator segment from the base, the aforementioned snap-fit connection of the indicator member to the neck of the bottle will be broken, allowing the indicator segment to pass to a lower level of the neck. The indicator member will then be disposed exteriorly of the overlying shroud, including when the cap is replaced on the bottle after an initial or subsequent access to the contents of the bottle.

At least one embodiment of the closure of the present invention comprises an assembly which includes an integrated construction of the cap and spout. Such an integrated construction is operative to maintain the aseptic conditions during assembly of the cap, spout and bottle prior to the initial filling of the bottle with the selected ophthalmic or other solution. In more specific terms, and as recognized in the prior art, proper sterile conditions can be maintained by eliminating or significantly restricting the possibility of touching any structural part of the closure which comes into direct contact with the contained solution within the bottle. This specifically includes but is not necessarily limited to the spout.

Moreover, the aforementioned integrated construction embodied in the closure comprises the spout disposed in an initially fixed, but subsequently removable connection with the cap. As such, the spout is movable with the cap, as the cap is disposed in the aforementioned closing relation to the bottle neck. More specifically, when assembled the spout will be disposed at least partially into the access opening of the bottle and in sealing engagement therewith. However, due to the spout being integrated into a fixed, but removable connection on the interior of the cap, the spout will move with the cap, as the cap and spout are being connected, in the manner described, to the neck and access opening of the bottle. As should be apparent, the integrated location of the spout on the interior of the cap will prevent or significantly restrict it from being touched, while connecting the cap and spout to the bottle, such as subsequent to filling. In contrast, while the cap will be freely exposed in overlying in closing relation to the spout, it can be safely handled or manipulated to accomplish the connection of the cap and spout to the neck and access opening of the bottle. Aseptic conditions will be maintained because the cap will not come into direct contact with the ophthalmic solution or other contents of the bottle.

Further, the aforementioned fixed, removable integrated connection of the spout on the interior of the cap may be defined by a press fit or frictional engagement of the exterior of the outer segment of the spout with the interior surface of the cap. Such a frictional engagement and/or press fit attachment can be more specifically defined by one or more outwardly extending surface portions formed on the exterior surface of the outer segment of the spout. Therefore, the outer segment, including the one or more outer surface portions are disposed and dimensioned to accomplish the press fit, frictional engagement with correspondingly disposed interior surfaces of the cap. Such press fit or frictional engagement will be sufficient to fixedly but removably maintain attachment of the spout with the cap such as, but not limited to, during concurrent movement of the cap and spout into the closing engagement and/or relation with the neck and access opening of the bottle. In contrast, the un-threading of the cap from the neck of the bottle will result in a removal of the spout from the cap, as the cap disengages the neck of the bottle. This maintained placement and positioning spout in closing relation to the access opening is due at least in part to the fluid tight seal between the exterior surface of the inner segment of the spout and the interior surface of the bottle adjacent and/or contiguous to the access opening.

In the alternative, the integrated connection of the spout within the interior of the cap may be accomplished by a bayonet connector including two connecting segments. When utilized, different ones of the two connecting segments of the bayonet connector is attached to a different one of the spout, such as on the outer segment of the spout, and the cap, such as adjacent the interior surface thereof. The fixed connection and removable detachment of the two bayonet connecting segments facilitates a fixed but removable bayonet connection of the spout and the interior of the cap.

Yet additional features of the spout include the inner segment thereof being disposed in inwardly spaced relation from the exterior surface of the shroud. As indicated herein, the interior surface of the shroud may also include a connector structure, such as threads, which facilitate a threaded or rotational connection of the cap to the neck of the bottle. The inward spacing of the inner segment of the spout from the interior surface and connector structure of the shroud will allow the positioning of the outer end of the bottle neck to pass between the inner segment and the interior surface of the shroud, as the spout and the cap are secured to the bottle neck. As indicated, such attachment of the cap to the bottle neck will include the inner segment of the spout being disposed within and/or through the access opening in sealing engagement with the interior surface of the bottle contiguous to the access opening.

Structural details of the spout comprise the inclusion of a flow channel formed in the spout and extending therethrough. When the cap is connected to the neck of the bottle in closing relation thereto, the flow channel is disposed in fluid communication with an interior of the bottle, via the bottle access opening, concurrent to the spout being connected in closing sealing relation to the access opening of the bottle. When so connected, the spout is at least partially disposed within the bottle access opening, concurrent to the spout connected to the bottle neck. As with known dispensing of ophthalmic solutions, such as a conventional eyedropper, the dispensing of the ophthalmic solution is in droplets or by a "drop-by-drop" manner. Therefore, the dimension, configuration and overall structure of the flow channel, as well as the spout itself, may be such as to define a droplet dispensing of the fluid within the interior of the bottle.

In at least one embodiment, the present invention further comprises the closure having an integrated construction between the cap and a spout, but also being absent the hidden or shrouded indicator member, which is structurally operative to provide an indication of tampering. Moreover, this additional embodiment is directed to a closure comprising a cap including a shroud, wherein the shroud includes an open end. Further, the spout is connected in fixed, removable engagement with the cap to define the integrated construction therebetween.

As set forth above, such an integrated fixed but removable attachment ensures that the spout is movable with the cap into a closing relation to a bottle access opening. Similarly, the spout includes an inner segment disposed within the access opening of the spout in sealing engagement with the adjacent or contiguous interior surfaces of the bottle. As indicated, the spout also includes an outer segment disposed in the aforementioned fixed, but removable connection with interior surface portions of the cap, to define the aforementioned integrated connection therebetween. Also similarly, the inner segment is disposed in inwardly spaced relation to an inner surface of the shroud concurrent to the fixed, removable connection of the outer segment with the interior surfaces of the cap.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is directed to an assembly generally indicated as 100 for the containment and dispensing of a solution specifically including, but not limited to, the containment and dispensing of an ophthalmic or other medical solution, preparation, compound, etc. Moreover, structural and operative features of the various components of the assembly 100 enable the intended attachment or connection to one another in a manner which maintains either required or desired aseptic conditions or techniques. Such aseptic conditions or techniques include, but are not limited to, the avoidance of contact with portions of the assembly which come into direct engagement with the solution, compound, etc. being dispensed. The subject assembly 100 may be specifically used for the droplet or "drop-by-drop" dispensing of an ophthalmic solution and as such, be in the form of an eyedropper assembly. However, it is again pointed out that the versatility of the present invention enables the containment and dispensing of solutions other than ophthalmic or medical solutions.

Figure 1:
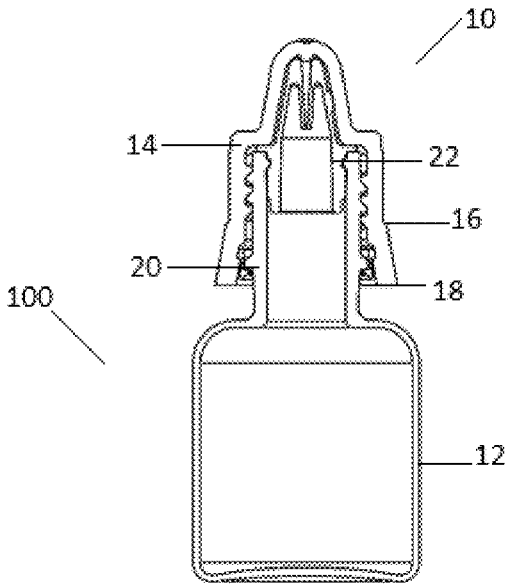
FIG. 1 is a sectional interior view of one embodiment of the present invention.
Figure 2:
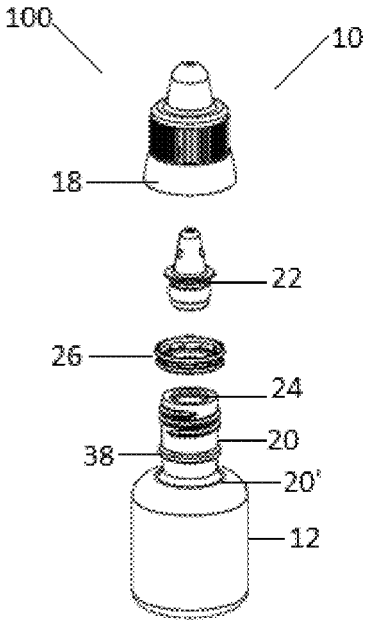
FIG. 2 is an exploded exterior view of the embodiment of FIG. 1.

Therefore, and with initial reference to FIGS. 1-2, at least one embodiment of the present invention includes a closure generally indicated as 10 for a medical or other solution retaining container, which may be in the form of a bottle 12. As explained in greater detail hereinafter, one or more embodiments of the present invention may utilize a somewhat conventionally structured bottle. In the alternative, and as discussed in greater detail hereinafter, the bottle 12 may be structured to include at least some customized structural and operative features.

Figure 3:
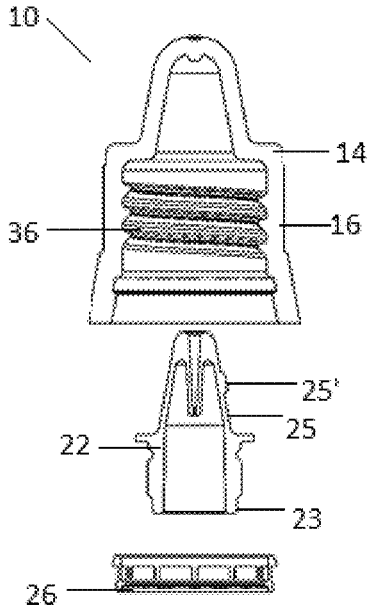
FIG. 3 is an exploded view in section of a closure operatively and structurally associated with the embodiment of FIGS. 1 and 2.
Figure 4:
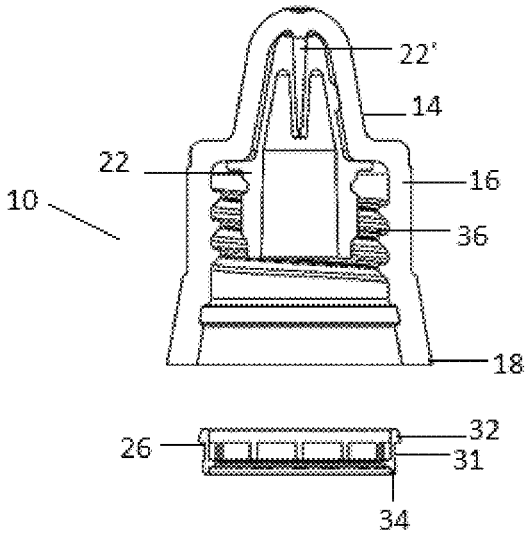
FIG. 4 is a partially exploded view in section of the embodiment of FIGS. 1-3.

Further, at least one embodiment of the closure 10 includes a cap 14 including a shroud 16 as perhaps best shown in FIGS. 1, 3 and 4, having an open end 18 through which a neck portion 20 of the bottle 12 passes to accomplish a connected, closing relation of the cap 14 with the bottle neck 20. In cooperation therewith, a spout or nozzle 22 is disposed in closing relation or engagement with an access opening 24 of the bottle 12. The shroud 16 of the cap 14 is disposed, dimensioned and structured to surround and substantially enclose an at least partially hollow interior of the cap 14. Also, the closure 10 may include an indicator member 26, as perhaps best shown in FIGS. 3 and 4, that is structured to provide evidence of tampering to the extent of providing a clear visual indication of an initial removal of the cap 14, from the aforementioned closing relation to the neck 20 and or access opening 24 of the bottle 12.

As represented throughout FIGS. 1-9, in at least one embodiment, the indicator member 26 includes a base 28 and an indicator segment 29, wherein the indicator segment 29 is removably and/or detachably connected to the base 28. As manufactured, the indicator member 26 may be formed by injection molding and be assembled within the cap 14, preferably by fixedly disposing, connecting or attaching the base 28 to an interior portion, as at 31 in FIG. 6, of the cap 14 in a fixedly secured position. In such a fixedly secured position, the indicator member 26 is disposed on the interior of the cap 14 and in inwardly spaced relation to the open-end 18 of the shroud 16. Also, in such a secured interior position, the indicator member 26 will not be visually observable from an exterior of the cap 14, when the cap 14 is disposed in the aforementioned closed relation to the neck 20 of the bottle 12 and the access opening 24, as represented in at least FIGS. 1, 7, 9.

For purposes of clarity, it is emphasized that the non-visually observable interior fixed or secured disposition of the indicator member 26, while connected on the interior of the cap 14, and concurrent to the cap being secured or disposed in closing relation to the bottle 12, is meant to describe a significant difficulty of viewing the indicator member 26. This is due at least in part to the cooperative structuring of the closure 10, including the cap 14 and the dimension and configuration of the bottle 12 which would render viewing of the indicator member 26, while intact within the interior of the cap 14, difficult, but not necessarily impossible.

Additional structural and operative features of the indicator member 26 include a base 32 and an indicator segment 34. The indicator segment 34 is removably attached to the base 32 of the indicator member 26 preferably by a frangible, breakable connection 31. The structural features of such a frangible connection 31 are such as to cause the breakage thereof and the detachment of the indicator segment 34 from the base 32 upon a removal of the cap 14 from its connected, closed relation to the neck 20 and access opening 24 of the bottle 12. Further structural features of the frangible connection 31 comprise it including or being formed of at least one or a plurality of frangible segments 31'.

Figure 5:
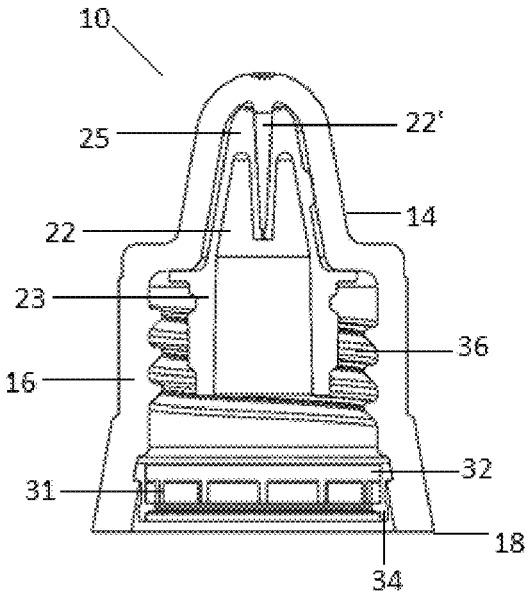
FIG. 5 is a sectional interior view representing the assembled closure of the embodiment of FIGS. 1-4.

As represented in at least FIGS. 4 and 5, a connector structure 36 is formed on the interior of the cap 14 and more specifically, on the interior of the shroud 16. The cooperative structuring of the cap 14 and the exterior portion of the bottle neck 20 may be such as to at least partially define a removable, threaded attachment of the cap 14 to the neck 20 of the bottle 12. Accordingly, as at least schematically represented in FIG. 8, an unscrewing or unthreading of the cap 14, relative to the bottle neck 20, will result in both rotational forces (i.e., torque) and axial load or force 39 being exerted on the indicator member 26. In that the base 32 is secured to the interior surface of the cap 14 and/or shroud 16, it is movable therewith upon removal of the cap 14 from the bottle 12.

Figure 8:
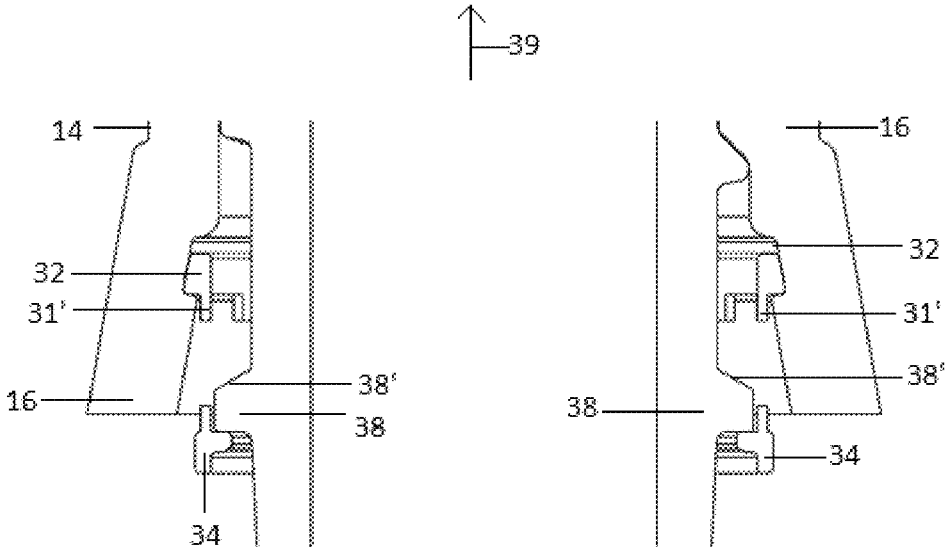
FIG. 8 is a detail interior sectional view in partial cutaway of the closure and indicator member concurrent to removal of the closure from the bottle of FIGS. 1 and 2.
Figure 9:
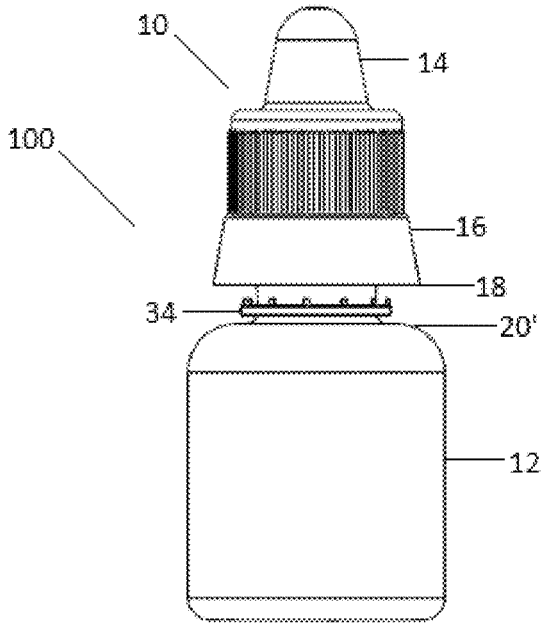
FIG. 9 is an exterior view of the embodiment of FIG. 1 with removal and replacement of the closure relative to the bottle.
Figure 10:
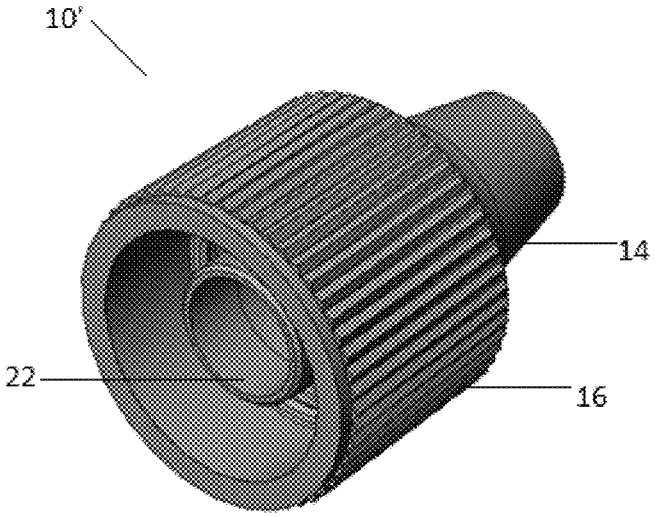
FIG. 10 is a perspective view of yet another preferred embodiment of the closure of the present invention.
Figure 11:
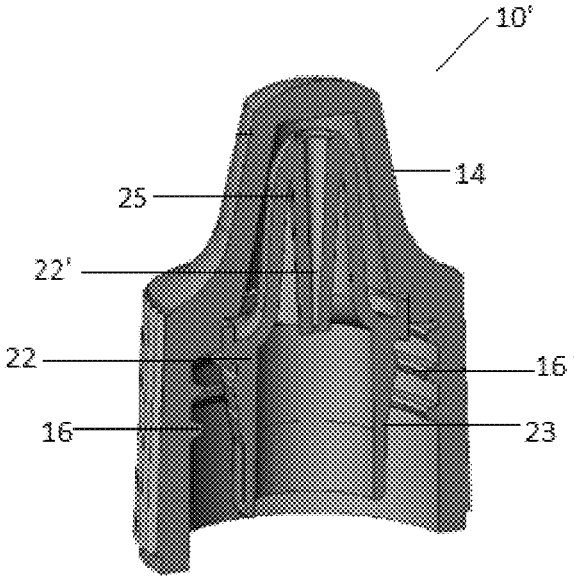
FIG. 11 is a perspective interior view in section of the embodiment of FIG. 10.
Figure 12:
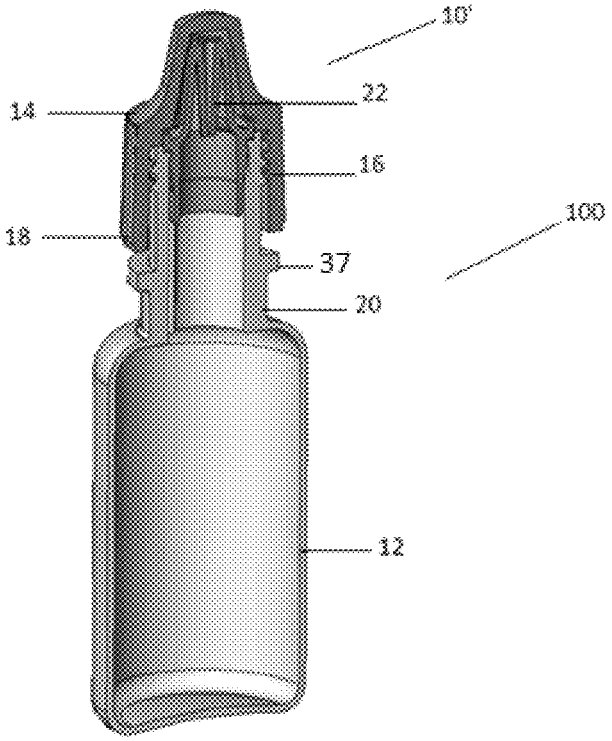
FIG. 12 is a perspective interior view in section of the closure of the embodiment of FIGS. 10 and 11 attached to a container or bottle.

Again with reference to FIG. 8, the exertion of such a removal force (torque and axial load) will be sufficient to break the frangible connection 31, causing a detachment of the indicator segment 34 from the base 31. Once so detached, the indicator segment 34 will fall, pass or drop through the open end 18 of the shroud 16 onto a lower portion of the neck 20' as represented in FIG. 9. The dimension and configuration shroud 16 are such as to leave an uncovered space or opening 20' on the neck 20 below the open end 18 of the shroud 16. Therefore, upon disconnection of the indicator segment 34 from the base 32, and the passage of the detached indicator segment 34 through the open end 18 of the shroud 16, it will be disposed within the opening or space 20' in a position which is clearly, visually observable. This visually observable position, as perhaps best represented in FIG. 9, of the detached indicator segment 34 would occur even when the cap 14 is reconnected or reattached in the closing relation to the bottle neck 20 and access opening 24 of the bottle 12, after an original or subsequent access to the contents of the bottle 12 has occurred.

Further, the visually observable location of the indicator segment 34, once detached from the base 32 (e.g., as shown in FIG. 9) will be sufficiently removed or spaced from the open end 18 of the shroud 16 to facilitate its visual observation. Accordingly, the tamper evident capabilities of the indicator member 26 will include the clear visual observation of the indicator segment 34, once detached from the base 32 of the indicator member 26, as the cap 14 is removed or unscrewed from the neck 20 of the bottle 12, as represented in FIG. 8. Moreover, if and when the cap 14 is reconnected or attached to the neck 20 in closing relation to the access opening 24 of the bottle 12, the detached indicator segment 34 will still remain exteriorly of the shroud 16 and thereby, be clearly observable as also represented and shown in FIG. 9. The ability to observe the detached indicator segment 34 will provide a clear indication that the cap 14 had been previously and/or originally removed, rendering contents of the bottle 12 accessible and no longer sterile. In order to further emphasize the location of the detached indicator segment 34 when disposed exteriorly of the shroud 16, it may include a bright or easily noticeable color, preferably distinguishable from the color of the cap 14 or bottle 12.

Yet additional structural features of at least one embodiment of the present invention include the indicator member 26, including both the base 32 and the indicator segment 34, having a substantially annular or ring-like configuration. As such, the indicator member 26 when intact and fixedly connected to the interior surface of the cap 14 and/or shroud 16, will be disposed inwardly from the open end 18 of the shroud 16. When the cap 14 is connected in the closing relation to the neck 20 and access opening 24 of the bottle 12, the indicator member 26, including the base 32 and the indicator segment 34, will be disposed in surrounding relation to the neck 20 of the bottle 12 as represented in at least FIG. 1.

Figure 6:
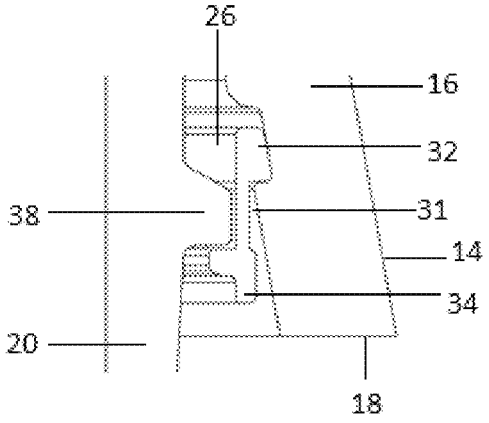
FIG. 6 is a detail view in partial cutaway of an indicator member assembled in the manner represented in FIG. 5.

In order to facilitate the aforementioned detachment of the indicator segment 34 from the base 32, the indicator member 26 is cooperatively structured with a portion of the neck 20 of the bottle 12, such as with an exterior protrusion 38 formed thereon, to enable a snap-fit connection therebetween, as represented in FIG. 6. Such a snap-fit connection is facilitated by a portion of the indicator member 26 such as, but not limited to, the frangible structure or connection 31 being at least minimally flexible. In cooperation therewith, the indicator segment 34 or other appropriate portion of the indicator member 26 will be cooperatively disposed and structured with the aforementioned exterior protrusion 38 on the neck 20 of the bottle 12. As also represented in at least FIGS. 6 and 8, the exterior protrusion 38 may have a slanted or angled surface as at 38' thereby facilitating the movable sliding engagement of the indicator segment 34 therewith, so as to pass over the exterior protrusion 38 into the snap-fit connection as represented in FIG. 6. Therefore, when the cap 14 is screwed or threaded or otherwise secured onto the bottle 12, in closing relation to the neck 20 and the access opening 24, the indicator segment 34, while still being connected to the base 32 of the intact indicator member 26, will movably engage and slide over an appropriately and cooperatively configured exterior 38' of the aforementioned exterior protrusion 38 extending outwardly from the outer surface of the bottle neck 20.

Therefore, such a snap-fit connection will further facilitate an initially secure engagement of the indicator segment 34 with the neck 20 of the bottle 12 when it is still attached to the base 32, and while the base 32 of the indicator member 26 is fixedly secured to the interior surface of the shroud 16, as set forth above. However, upon detachment of the indicator segment 34 from the base 32, the aforementioned snap-fit connection of the indicator member 26 to the neck 20 of the bottle 12 will be broken, allowing the indicator segment 34 to pass to a lower level 20' of the neck 20. The indicator segment 34 will then be disposed exteriorly of the overlying shroud 16, including when the cap 14 is replaced on the bottle 12 after an initial or subsequent access to the contents of the bottle 12.

Moreover, in at least one embodiment of the present invention, the closure 10 comprises an assembly 100, which includes an integrated construction of the cap 14 and spout 22. Such an integrated construction is operative to maintain the aseptic conditions during assembly of the cap 14, spout 22 and bottle 12 prior to the initial filling of the bottle 12 with the selected ophthalmic or other solution. In more specific terms and as recognized in the prior art, proper sterile conditions can be maintained by eliminating or significantly restricting the possibility of touching any structural part of the closure 10 which comes into direct contact with the contained solution within the bottle 12. This specifically includes, but is not necessarily limited to, the spout 22.

With reference to at least FIGS. 2 and 3, the spout 22 includes an inner segment 23 and an outer segment 25. When the spout 22 is secured within the access opening 24, the inner segment 23 passes into the interior thereof and the exterior surfaces of the inner segment 23 define a fluid sealing engagement with the interior surfaces of the bottle 12, which are contiguous to the access opening 24. At the same time, the outer segment 25 extends outwardly from the access opening 24 and corresponding terminal end of the neck 20 of the bottle 12.

Moreover, the aforementioned integrated construction embodied in the closure comprises the spout 22 disposed in an initially fixed, but subsequently removable connection with the cap 14. As such, the spout 22 is movable with the cap 14 as it is disposed in the aforementioned closing relation to the bottle neck 20. More specifically, and when assembled, the inner segment 23 of the spout 22 will be disposed at least partially into the access opening 24 of the bottle 12 and in sealing engagement therewith. However, due to the spout 22 being integrated into a fixed, but removable connection on the interior of the cap 14, the spout 22 will move with the cap 14, when the cap 14 and the spout 22 are being collectively connected, in the manner described, to the neck 20 and access opening 24 of the bottle 12. As should be apparent, the integrated location of the spout 22 on the interior of the cap 14 will prevent or significantly restrict it from being touched while connecting the cap 14 and spout 22 to the bottle 12, such as subsequent to filling. In contrast, while the cap 14 will be freely exposed in overlying at least partially enclosing relation to the spout 22, it can be safely handled or manipulated to accomplish the connection of the cap 14 and spout 22 to the neck 20 and access opening 24 of the bottle 12. Aseptic conditions will be maintained because the cap 14 will not come into direct contact with the ophthalmic solution or other contents of the bottle.

Further, the aforementioned fixed, removable integrated connection of the spout 22 on the interior of the cap 14 may be defined by a press fit or frictional engagement of the exterior of the outer segment 25 of the spout 22 with the interior surface of the cap 14, as represented in FIG. 1 as well as the embodiment of FIGS. 10-14. Such a frictional engagement and/or press fit attachment can be more specifically defined by one or more outwardly extending surface portions 25' formed on the exterior surface of the outer segment 25 of the spout 22 (see FIGS. 1 and 3). Therefore, the outer segment 25, including the one or more outwardly extending surface portions 25' are disposed and dimensioned to accomplish the press fit, frictional engagement with correspondingly disposed interior surfaces of the cap 14. Such press fit or frictional engagement will be sufficient to fixedly but removably maintain attachment of the spout 22 within the cap 14 such as, but not limited to, during concurrent movement of the cap 14 and spout 22 into the closing engagement and/or relation with the neck 20 and access opening 24 of the bottle 12. In contrast, the unthreading or otherwise removal of the cap 14 from the neck 20 of the bottle 12 will result in a removal or detachment of the spout 22 from the cap 14, as the cap 14 disengages the neck 20 of the bottle 12. This maintained placement and positioning inner segment 23 of the spout 22 in closing relation to the access opening 24 is due at least in part to the fluid tight seal between the exterior surface of the inner segment 23 of the spout 22 and the interior surface of the bottle 12 adjacent and/or contiguous to the access opening 24.

Figure 13:
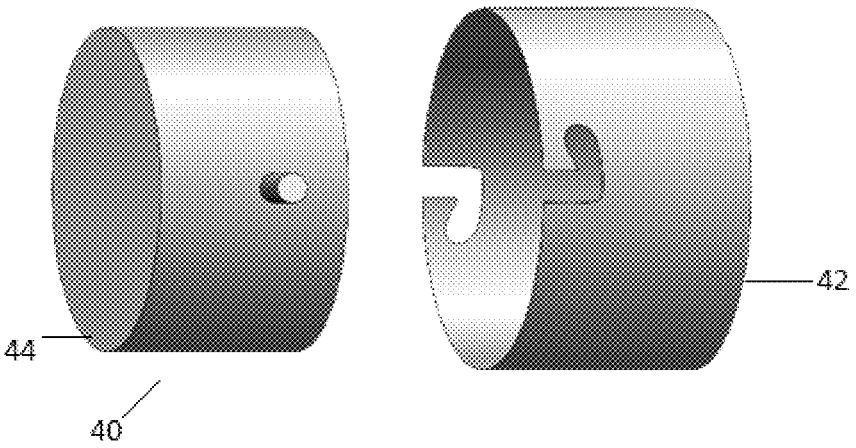
FIG. 13 is a perspective view of yet another embodiment of the present invention directed to connecting structure which may be operatively associated with the closure of the embodiment of FIGS. 10-12.
Figure 14:
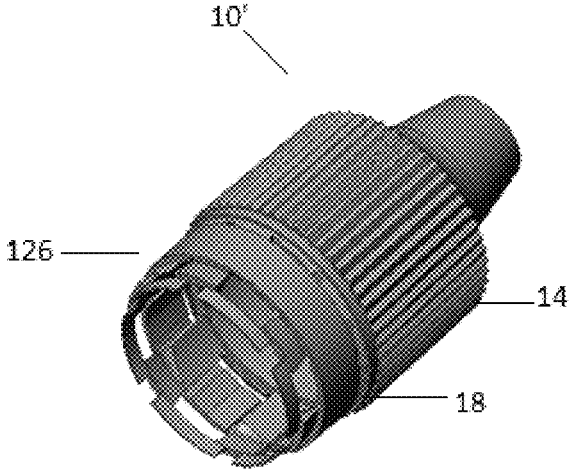
FIG. 14 is a perspective view of yet another embodiment of the present invention wherein a tamper evident indicator member is operatively associated with the embodiment of FIGS. 10-12.

In the alternative, the integrated connection of the spout 22 within the interior of the cap 14 may be accomplished by a bayonet connector 40 including two connecting segments 42 and 44, as represented schematically in FIG. 13. When utilized, different ones of the two connecting segments 42 and 44 of the bayonet connector 40 is attached to a different one of the spout 22, such as on the outer segment of the spout 22, and the cap 14, such as adjacent the interior surface thereof. A fixed connection and removable detachment of the two bayonet connecting segments 42 and 44 facilitates a fixed but removable bayonet connection of the spout 22 and the cap 14.

Yet additional features of the spout 22 include the inner segment 23 being disposed in inwardly spaced relation from the exterior surface of the shroud 16, as perhaps best represented in FIG. 1. As set forth herein, the interior surface of the shroud 16 includes the connector structure 36, such as threads, which facilitate a threaded or rotational connection of the cap 14 to the neck 20 of the bottle 12. The inward spacing of the inner segment 23 of the spout 22 from the interior surface and connector structure 36 of the shroud 16 will allow the positioning of the outer end of the bottle neck 20 to pass between the inner segment, as it passes into the access opening 24, and the interior surface of the shroud 16. This will occur as the spout 22 and the cap 14 are secured to the bottle neck 20 in the manner described herein and represented in FIG. 1. As indicated, such attachment of the cap 14 to the bottle neck 20 will include the inner segment 23 of the spout 22 being disposed within and/or through the access opening 24 in sealing engagement with the interior surface of the bottle 12 which is contiguous to the access opening 24.

Additional structural details of the spout 22 include a flow channel 22' formed in and extending therethrough as clearly represented in FIGS. 1, 4 and 5. When the cap 14 is connected to the neck 20 of the bottle in closing relation thereto, the flow channel 22' is disposed in fluid communication with an interior of the bottle 12, via the bottle access opening 24, concurrent to the spout 22 and the inner segment 23 thereof connected in closing sealing relation to the access opening 24. As with known dispensing of ophthalmic solutions, such as a conventional eyedropper, the dispensing of the ophthalmic solution is by droplets or by a "drop-by-drop" manner. Therefore, the dimension, configuration and overall structure of the flow channel 22' as well as the spout 22 itself may be such as to define a droplet dispensing of the fluid within the interior of the bottle 12.

To further clarify the present invention, a sequential review of FIGS. 3-9 indicates the structural and operative features thereof. More specifically, FIG. 3 represents the closure 10 including the cap 14, spout or nozzle 22 and indicator member 26 ready for attachment or interconnection in an operative, intended manner. As represented in FIG. 4, the spout 22 is inserted into the interior of the cap 14 and in at least one embodiment the spout 22 may be fixedly but removably integrated with the cap 14 in the manner set forth above. After interconnection of the spout 22 on the interior of the cap 14, the indicator member 26 is secured in its at least a partially fixed operative position within the interior of the cap 14, as represented in FIG. 5. As indicated, such fixed attachment of the indicator member 26 is accomplished by a fixed attachment, securement, etc. of at least the base 34 to the interior surface of the shroud 16.

Figure 7:
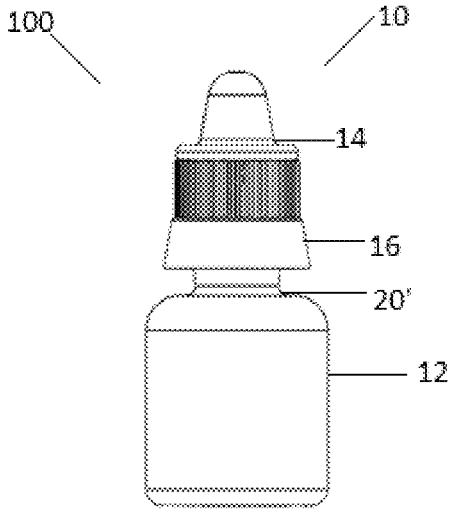
FIG. 7 is an assembled exterior view of the embodiment of FIG. 1-6.

More specifically, FIG. 6 represents the detailed interconnection of the indicator member to the cap 14 wherein the base 32 is fixedly connected or secured to the interior surface of the shroud 16. At the same time, the hidden, shrouded indicator member 26, while still intact, is secured by a snap-fit connection to the protrusion 38 extending outwardly from the neck 20 of the bottle 12. Accordingly, while the indicator member 26 is still intact it, is disposed within the interior of the shroud 16 in a non-observable location when the closure 10 and cap 14 are secured to the neck 20 of the bottle 12, as represented in FIG. 7.

As described in detail herein, FIG. 8 represents a removal of the cap 14 from the neck 20 of the bottle 12 by virtue of a rotational force (i.e., torque) and/or axial load or force 39 being exerted on the cap 14 and shroud 16. Such removal force will result in a detachment of the indicator segment 34 from the base 32 of the indicator member 26 due to a breakage of the one or more frangible members 31' which comprise the frangible connection 31. Upon such detachment, the indicator segment 34 will no longer be connected to the exterior protrusion 38 by the aforementioned snap-fit connection. As a result, the indicator segment will fall to a portion on the neck indicated in FIG. 9 as 20', wherein such location 20' is beneath and/or exterior of the shroud 16, including when the cap 14 has been reattached to the bottle 12 in closing relation to the neck 20 thereof, as also represented in FIG. 9. Moreover, in such a position 20' the indicator segment 34 will be clearly visible and observable, thereby providing a possible indication of tampering and more specifically, provide a clear visual indication that the cap 14 has been initially or previously removed from the bottle 12.

As represented in the embodiment of FIGS. 10-14, in another embodiment the present invention comprises the assembly 100 (e.g., see FIG. 1) incorporating the closure 10', including an integrated construction between the cap 14 and spout 22, but being absent the hidden or shrouded indicator member 26 of the type represented in the embodiment of FIGS. 1-9. Instead, the cover 10' cap 14 may be totally absent a tamper indicating structure or in the alternative, may include an indicator member 26 connected to the exterior of the shroud 16 adjacent or contiguous to the open end 18. The fixed integrated connection of the spout 22 within the interior of the cap 14 may be accomplished by the aforementioned frictional and/or press fit engagement of the exterior surface of the outer segment 25 to the interior surface of the cap 14 and/or shroud 16 using similar structural features such as the aforementioned outwardly projecting surface portion 25' as represented in FIG. 3. Accordingly, the spout 22 is integrated into the cap 14 by virtue of the connected fixed, but removable engagement of the spout 22 within the cap 14 to define the integrated construction therebetween.

In the alternative, and as also set forth above the fixed, removable integrated connection of the spout 22 within the interior of the cap 14 and/or shroud 16 may be accomplished utilizing the bayonet connector 40 as represented in FIG. 13. Therefore, and as represented, the integrated connection of the spout 22 within the interior of the cap 14 may be accomplished by a bayonet connector 40 including two connecting segments 42 and 44, wherein different ones of the two connecting segments 42 and 44 of the bayonet connector 40 is attached to a different one of the spout 22, and the cap 14. A fixed connection and removable detachment of the two bayonet connecting segments 42 and 44 facilitates a fixed but removable bayonet connection of the spout 22 and the cap 14.

In another embodiment of the present invention, the bottle 12 is adapted for containment of the solution to be dispensed. As such, the bottle may comprise a customized construction and be formed as one piece such as by injection molding. This customized bottle 12 may be specifically structured to accomplish interaction with the aforementioned hidden or shrouded indicator member of the embodiment of FIGS. 1-9. As so structured, the customized bottle 12 may include the aforementioned outer protrusion 38 as represented in FIGS. 6 and 8. In addition, and with reference to FIG. 12, the customized structuring of the bottle 12 may also include an additional rib-like member 37 which may be disposed and structured to effectively "catch" the indicator segment 34 as it is detached from the base 32 and passes outwardly from the interior of the shroud 16 through the open end 18 thereof.

Figure 15:
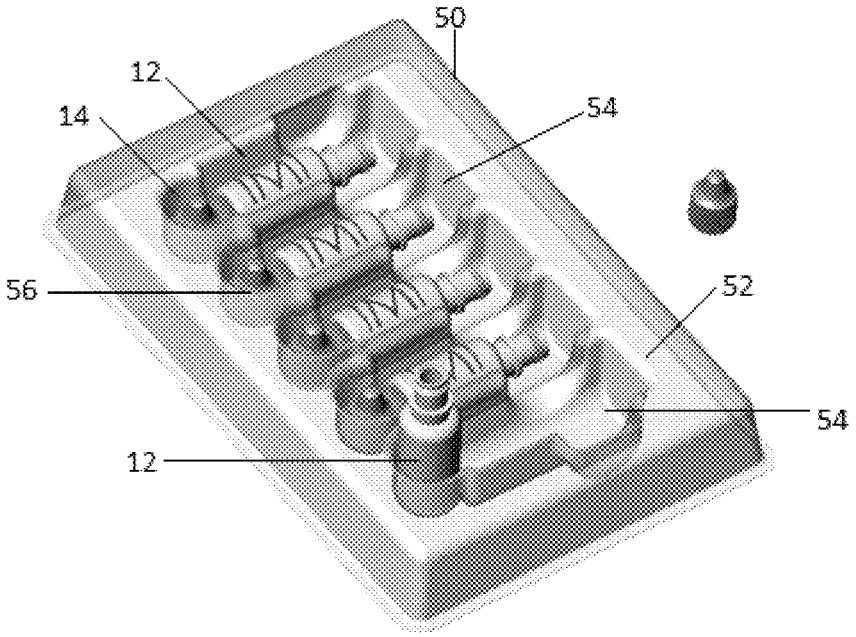
FIG. 15 is a perspective view of a packaging and assembly tray facilitating the storage and filling of the embodiment of FIGS. 1 and/or 12.

Yet another embodiment of the present invention is represented in FIG. 15 and is directed to a tray, generally indicated as 50. The tray 50 may be utilized in a sterile environment for packaging and is also structured to facilitate the filling of the individual bottles 12. More specifically, the tray 50 includes a plurality of cavities 52, each or at least some of which include an elongated cavity segment 54 having a substantially elongated horizontal orientation and a smaller cavity segment 56 having a substantially vertical orientation. In use, and as represented, one or more bottles 12 prior or subsequent to being filled may be disposed in the cavity segments 54 having the aforementioned elongated configuration and horizontal orientation. Concurrently, and prior to being filled, one or more covers 10 or 10' may be disposed in the smaller, generally vertically oriented cavity segments 56. However, during the filling procedure, the empty bottles 12 will be disposed in a vertical orientation in the cavity segments 56 so as to be disposed and maintained in a substantially upright orientation. Such an upright orientation facilitates filling thereof, and upon the filling of a bottle 12 being completed, a corresponding one of the covers 10 or 10' is threaded onto the filled bottle in the manner described herein. Moreover, the one or more smaller cavity segments 56 may have an interior structure which restricts rotation of the contained bottle 12 during the rotational, threaded attachment of a cover 10 or 10' thereto.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A closure for a medical solution containing bottle, said closure comprising:

a cap including a shroud, said shroud having an open end, said cap removably connected to the bottle in closing relation to a bottle neck and a bottle access opening, an indicator member connected to an interior surface of said shroud inwardly of said open end, in a non-observable location, said indicator member including a base and an indicator segment, said indicator segment removably connected to said base, said indicator member connected to the bottle neck concurrent to said closing relation of said cap to the bottle neck and the bottle access opening, and said indicator segment detachable from said base and disposed on the bottle neck exteriorly of said shroud, concurrent to a removal of said cap from the bottle.

2. The closure as recited in claim 1 wherein said indicator segment is disposed in a visually observable location on the bottle neck, concurrent to a detachment thereof from said base and said removal of said cap from the bottle.

3. The closure as recited in claim 2 wherein said indicator segment is disposed in a visually observable location on the bottle neck, concurrent to said detachment thereof and concurrent to a replacement of said cap in the said closing relation to said to the bottle neck and the bottle access opening.

4. The closure as recited in claim 1 wherein said indicator segment is disposed in a visually observable location on the bottle neck, concurrent to a detachment thereof from said base and concurrent to a replacement of said cap in the said closing relation to said 29 to the bottle neck and the bottle access opening.

5. The closure as recited in claim 1 further comprising a frangible structure disposed in interconnecting relation between said base and said indicator segment.

6. The closure as recited in claim 5 wherein said frangible structure comprises a plurality of frangible segments disposed in spaced relation to one another along a co-extending the length of said base and said indicator segment.

7. The closure as recited in claim 6 wherein said indicator member comprises an annular configuration disposed in surrounding relation to the bottle neck, concurrent to said closing relation of said cap to the bottle neck and the bottle access opening.

8. The closure as recited in claim 1 wherein said indicator member is cooperatively structured with the bottle neck to define a snap-fit connection therewith.

9. The closure as recited in claim 8 wherein said cooperative structure of said indicator member comprises an at least partially a flexible, frangible interconnection of said indicator segment to said base.

10. The closure as recited in claim 1 further comprising a spout including a flow channel formed therein, said flow channel disposed in fluid communication with an interior of the bottle, via the bottle access opening, concurrent to said spout connected to the bottle neck.

11. The closure as recited in claim 10 wherein said spout is at least partially disposed within the bottle access opening concurrent to said spout connected to the bottle neck.

12. The closure as recited in claim 10 wherein said flow channel is dimensioned and configured to define a droplet dispensing of the medical solution from the bottle.

13. The closure as recited in claim 10 wherein said spout is integrated into said cap in a fixed, removable connection therewith, said spout movable with said cap into said closing relation of said cap to the bottle access opening.

14. The closure as recited in claim 13 wherein said spout includes an inner segment and an outer segment, said flow channel formed in said outer segment in fluid communication with an interior of said inner segment.

15. The closure as recited in claim 14 wherein said inner segment is disposed into and through the bottle access opening concurrent to said spout connected to the bottle neck.

16. The closure as recited in claim 13 wherein said inner segment is disposed in inwardly spaced relation to an inner surface of said shroud, concurrent to said fixed, removable connection with said cap.

17. The closure as recited in claim 16 further comprising a connector structure formed on said interior surface of said cap in spaced relation to said inner segment.

18. The closure as recited in claim 17 wherein said connector structure is cooperatively disposed and configured with the bottle neck to define a removable, threaded attachment therebetween concurrent to said closing relation of said cap to the bottle neck and the bottle access opening.

19. The closure as recited in claim 13 wherein said fixed, removable connection of said spout with said cap comprises a frictional engagement of an exterior surface of said spout with an interior surface of said cap.

20. The closure as recited in claim 19 wherein said spout comprises at least one outwardly extending surface portion disposed in said frictional engagement with said interior surface of said cap.

21. The closure as recited in claim 13 wherein said spout is integrated into said cap in a fixed, removable connection therewith, said fixed, removable connection comprising a bayonet connector, said bayonet connector including two connecting segments cooperatively structured to define a bayonet attachment between said spout and said cap.

22. The cover as recited in claim 21 wherein each of said two connecting segments is secured to a different one of said spout and said cap.

23. An assembly for containing and dispensing a medical solution, said assembly comprising:

a closure including a cap and a bottle, said bottle structured for containment of the medical solution, said closure including a cap having a shroud, said shroud having an open end, said cap removably connected to said bottle in closing relation to a bottle neck and a bottle access opening, an indicator member connected to an interior surface of said shroud inwardly of said open end, in a non-visually observable location, said indicator member including a base and an indicator segment, said indicator segment removably connected to said base, said indicator member connected to said bottle neck concurrent to said closing relation of said cap to said bottle neck and said bottle access opening, said indicator segment detachable from said base and disposed on the bottle neck exteriorly of said shroud, concurrent to a removal of said cap from said bottle, said bottle including an exterior projection formed on said neck in a location within said shroud concurrent to said closing relation of said cap to said bottle neck and said bottle access opening, said indicator member cooperatively structured with said exterior projection to define a snap-fit connection of said indicator member on said bottle neck on an interior of said shroud, and said indicator segment is disposed exteriorly of said shroud in a visually observable location on the bottle neck, concurrent to detachment from said base and concurrent to removal of said cap from said bottle.

24. The assembly as recited in claim 23 wherein said indicator segment is disposed in a visually observable location on the bottle neck, concurrent to a detachment thereof from said base and concurrent to a replacement of said cap on said bottle neck.

* * * * *